United States Patent [19]

Van Haaften

[11] 3,937,002

[45] Feb. 10, 1976

[54] SOLID STATE, BATTERY OPERATED ELECTRONIC WATCH HAVING ARM-ACTUATED SWITCH

[75] Inventor: Egbert Van Haaften, Closter, N.J.

[73] Assignee: Bulova Watch Company, Inc., New York, N.Y.

[22] Filed: Aug. 20, 1974

[21] Appl. No.: 499,015

[52] U.S. Cl. ..... 58/23 BA; 58/33; 58/50 R; 200/19 R

[51] Int. Cl.[2]... G04C 3/00; G04B 19/30; H01H 35/02

[58] Field of Search..... 200/19 R, 24, 61.48–61.51; 240/6.43; 58/19 R, 23 R, 23 A, 23 V, 27, 28, 29, 39.5, 50 R, 58, 57, 85.5, 33, 23 BA

[56] References Cited

UNITED STATES PATENTS

| | | | |
|---|---|---|---|
| 2,291,338 | 7/1942 | Leathers | 200/19 R |
| 2,763,740 | 9/1956 | Vazquez | 200/19 R |
| 2,853,849 | 9/1958 | Beyner | 200/19 R |
| 3,063,234 | 11/1962 | Detwiler | 200/19 R X |
| 3,631,451 | 12/1971 | Schmitt | 58/19 R X |
| 3,748,847 | 7/1973 | Kouchi | 58/57 X |
| 3,756,013 | 9/1973 | Bergey et al. | 58/39.5 X |
| 3,789,601 | 2/1974 | Bergey | 58/50 R |
| 3,841,080 | 10/1974 | O'Donald | 58/50 R X |

*Primary Examiner*—James R. Scott

[57] ABSTRACT

An arm-actuated switch for a solid-state electronic watch having an electro-optic display. To conserve battery power, the display is normally quiescent and is momentarily turned on by the switch only when the wearer of the watch moves his arm in a particular way. The switch includes a pair of spaced contacts which when interconnected close the circuit. Such interconnection is effected by a shorting bridge formed by a pair of flexible tines which normally occupy positions adjacent to but out of touch with the contacts, the tines being flexed into engagement with the contacts by a pair of swingable mallets that are caused to swing and strike the tines only if the arm is moved in a predetermined manner.

11 Claims, 8 Drawing Figures

SOLID STATE, BATTERY OPERATED ELECTRONIC WATCH HAVING ARM-ACTUATED SWITCH

BACKGROUND OF THE INVENTION

This invention relates generally to solid-state electronic wrist watches having an electro-optic time display, and more particularly to a watch incorporating an arm-actuated switch for activating the display of the watch only when the wearer moves his arm in a predetermined manner.

The term "solid-state electronic wrist watch," as used herein, is limited to wrist-borne electronic timepieces provided with an electro-optic time display and having no moving parts. The traditional spring-powered mechanical watch produces rotary motion for driving gearworks that operate the moving hands or time indicators. In those electronic watches which also have a moving hand readout, the oscillations of a balance wheel or the vibrations of a tuning fork are electronically sustained, the oscillations or vibrations being converted into rotary motion for driving the gear train. Hence moving parts are included in electronic watches of this type.

However, in recently introduced types of solid-state electronic watches, electrical pulses derived from a crystal-controlled time base serve to actuate an electro-optic display formed either by light-emitting diodes (LED) or by liquid-crystal elements (LCD). Hence in such solid-state electronic timepieces, no moving parts are entailed.

In a battery-operated electronic watch having moving parts, such as that disclosed in Hetzel U.S. Pat. No. 2,971,323, the time display is continuous, yet the efficiency of the movement is such that the operating life of the small power cell is well over a year. But in a solid-state watch, the power requirements of the electro-optic display, particularly in the case of an LED display, are relatively high; hence should the display be continuous, the life of the battery would be quite brief.

It is for this reason that commercially available types of solid-state watches are provided with a normally quiescent display that is turned on only when the user depresses a push-button demand switch, thereby conserving power and prolonging the life of the battery. In one such watch, the display is programmed so that upon merely touching the push-button switch, the minutes and hours are indicated for an interval of one and one-quarter seconds, whereas continued depression of the switch causes the minutes and hour data to fade and the seconds to appear and to continue to count as long as the button is held in. In this arrangement, precise computation of time is continuous and independent of whether or not it is displayed, so that the moment the switch is depressed, timing signals are applied to the display.

Since the wearer of the solid-state watch has it strapped to the wrist of one arm, he is compelled to use his other arm to reach the switch and activate the time display. This requirement gives rise to certain practical difficulties, particularly if the other arm is engaged in some necessary activity. For example, one who is carrying a package or driving a car cannot press the demand switch on the watch worn on one arm, without first freeing his other arm.

This difficulty is recognized in Kouchi U.S. Pat. No. 3,748,847, which discloses a solid-state watch whose casing is provided at its rear with a rotatable plate operatively coupled to a switch for activating the display. To bring the face of the watch into view, the arm bearing the watch is twisted. This twisting motion causes movement of the skin in contact with the rotatable plate, as a result of which the plate rotates through an angle sufficient to operate the switch associated therewith. A rotatable plate arrangement of this type requires a special and relatively costly watch case, and it complicates the waterproofing of the case.

Alternative approaches to a wrist-actuated switch are found in Bergey U.S. Pat. No. 3,742,699, where in one embodiment the switch is fully enclosed in the case of the solid-state watch and hence requires no special casing structure. However, in this arrangement the switch takes the form of a conductive ball movable within a sleeve, the ball successively completing a circuit between the sleeve and spaced contacts coupled to separate flip-flop circuits to produce an output signal in response to sequential engagement of the contacts by the ball. Hence, in addition to the switch, this arrangement requires a special electronic circuit associated therewith to produce a switching signal.

One serious problem encountered in prior types of arm-actuated switches for solid-state watches is that the switch may be activated by random or accidental arm movements so that a time-display is produced without regard to demand. This inadvertent switching activity results in excessive current drain and shortens the life of the power cell.

SUMMARY OF THE INVENTION

In view of the foregoing, it is the main object of this invention to provide an arm-actuated switch for activating the electro-optic display of a solid-state watch only when the wearer moves his arm in a predetermined manner, the switch being unresponsive to random or accidental arm movements.

More particularly, it is an object of this invention to provide an arm-actuated switch unit which may be contained within a standard watch case and requires no special case design or associated electronic circuits to produce a switching action.

Yet another object of this invention is to provide an arm-actuated switch unit which is of simple, inexpensive and reliable design.

Still another object of the invention is to provide a time-display arrangement which is coordinated with the arm-actuated switching action such that when the display is oriented for optimum viewability, the switch is operated to light up the display.

Briefly stated, these objects are attained in an arm-actuated switch formed by a pair of spaced stationary contacts which when momentarily interconnected, complete a circuit to turn on the electro-optic display of the electronic watch. Ordinarily, the contacts are not interconnected, hence the display is normally quiescent. The momentary interconnection of the contacts is effected by a conductive shorting bridge formed by a pair of flexible tines symmetrically arranged with respect to the contacts so that the tines are both normally adjacent to, but out of touch with, the contacts.

The only way by which the bridge is able to interconnect the contacts is for both tines thereof to simultaneously engage both contacts. For this purpose, associated with the tines are a pair of swingable mallets so arranged that when the wrist is raised to a horizontal position and rotated in one direction, then the mallets are retracted from the tines, but when the wrist is then rotated in the reverse direction, the mallets swing from their retracted position to strike the tines with sufficient force to cause the tines to flex and engage the contacts, thereby closing the switch and activating the display. The position of the electro-optical display on the case is made such that optimum viewability is attaned just when the switch is closed.

OUTLINE OF THE DRAWINGS

For a better understanding of the invention, as well as other objects and features thereof, reference is made to the following detailed description, to be read in conjunction with the annexed drawings, wherein:

FIG. 8 is a section of the switch taken in the horizontal plane.

DESCRIPTION OF THE INVENTION

The Electronic Watch

Figure 1:
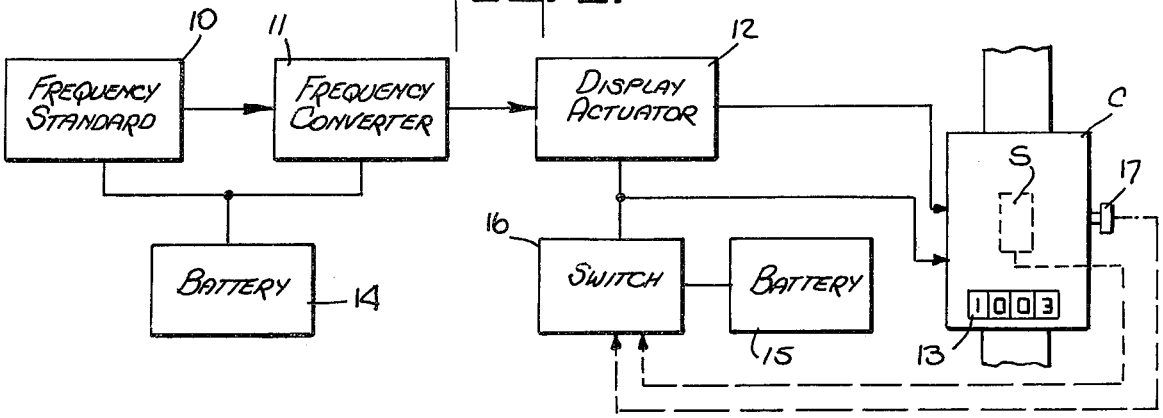
FIG. 1 is a block diagram of a solid-state watch including an arm-actuated switch in accordance with the invention.

Referring now to FIG. 1, there is shown in simplified block diagram, the main components of a solid-state electronic watch in accordance with the invention. The watch comprises a time base or frequency standard 10 in the form of a quartz-crystal high-frequency oscillator whose output is supplied to a converter 11 in the form of a multi-stage divider that divides down the frequency from standard 10 so that the output signal of the converter is at a suitable low timing rate, such as a pulse frequency of 1 Hz.

This signal is applied to a display actuator 12 constituted by a suitable logic circuit which controls a four-digit electro-optic time display, generally indicated by numeral 13. A suitable time display is a matrix of light-emitting diodes (LED), or of liquid-crystal display elements (LCD).

Figure 2:
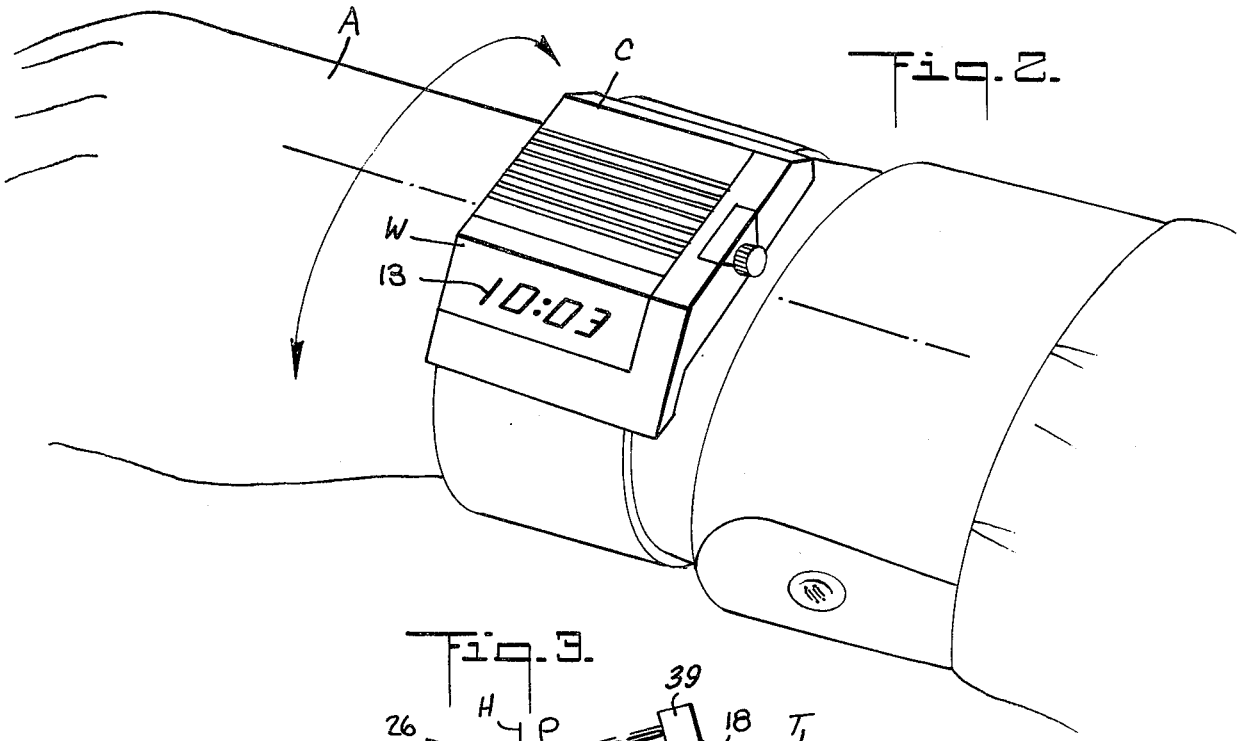
FIG. 2 shows in perspective the watch as carried on the wrist of a wearer.

Frequency standard 10 and frequency converter 11 are both energized by a first replaceable battery 14. The display actuator 12 and the time display 13 are energized by a second replaceable battery 15 under the manual control of a switching mechanism 16 operated by the crown and stem assembly 17 of the watch so that power from battery 15 is not drawn, and the electro-optic display is normally inactive save when the switch 16 is actuated in a particular manner. All of these solid-state components including the time display, are incorporated in a single module which is placed in a wrist-watch casing C, as shown in FIG. 2, with digital display 13 exposed through an end window W on the watch.

In normal operation, time is continuously kept but is not presented by display 13. That is to say, no time indication is visible, this being the normal condition which prevails in order to conserve the power of battery 15. However, even though time is not displayed, the electronic watch system continues to keep accurate time and is capable of displaying the time or calender date at any instant when the crown and stem assembly 17 is manually actuated.

Each of the four LED digits may be defined by a selectively-activated dot matrix. Alternatively, this display may be formed by a seven-bar segment composed of seven light-emitting diodes of elongated shape, so arranged that by energizing an appropriate combination of bars, any one of the numbers 0 through 9 may be presented. The invention is not limited to any one form of electro-optical display.

The display has three distinct states: the first being the time-of-day, given in hours and minutes; the second being seconds; and the third being calendar date. These states are under the control of crown and stem assembly 17, which operates the switching mechanism 16 whereby when the crown is depressed part-way, the time-of-day is displayed, when it is fully depressed, seconds are displayed, and when the crown is pulled out, the calendar date is presented. Since the display is electronically-actuated at the rate of one timing pulse per second, these pulses may be electronically counted and accumulated to afford a reading of seconds and a reading of minutes and hours. After every twenty-four hour interval is counted, the calendar date is advanced. Suitable decoder or logic circuits and all other electronic components are disclosed in U.S. Pat. Nos. 3,756,011 and 3,756,013.

A solid-state watch using a crown-operated switch to control the display is disclosed in greater detail in the co-pending application of Van Haaften, Ser. No. 413,370, filed Nov. 6, 1973. The present invention is not limited to this type of solid-state watch nor the particular type of manual switch disclosed in this application, the invention being usable with any known type of solid-state electronic watch including a manually-operated switch of the push-button or any other type which when momentarily actuated, produces a time-of-day (hours and minutes) electro-optic display.

THE SWITCHING PRINCIPLES

The present invention resides in an arm-actuated switch S which is incorporated in the module contained in case W and is shunted across the existing manually operated time-of-day switch so that switch S acts to activate the time-of-day display only when the watch, strapped on the wrist on one arm of the wearer, is moved in a predetermined manner, so that the switch undergoes a sequence of motions. The wearer may still, if he wishes, press the manually operated switch to obtain a time-of-day reading.

FIG. 2 shows the watch strapped on the wrist of the wearer's arm A, the end window W thereof facing the eyes of the wearer when the arm is raised to a horizontal position. The nature of the switch S and its orientation within case C are such that when the wearer raises his arm to the horizontal position and then rotates his arm about 90° in the clockwise direction, thereby shifting window W away from the wearer's line of sight, switch S is thereby cocked, and when the wearer then quickly rotates his arm in the counterclockwise direction to return window W to the line of sight where the window is best viewable, at that point the switch is fired to activate the time display. The invention is by no means limited to the specific window arrangement shown, and is applicable to any solid-state watch having a switch-operated time display.

Figure 3:
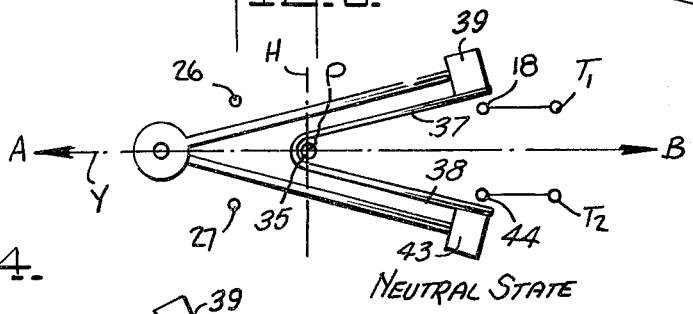
FIG. 3 is a schematic view of the switch in its quiescent state.

Referring now to FIG. 3, schematically showing the structure of switch S, it will be seen that the switch includes a pair of contacts 40 and 44 which are spaced apart so that the circuit between terminals $T_1$ and $T_2$ is open. In order to momentarily close this circuit and thereby activate the time display, a conductive shorting bridge is provided which is formed by a wire of spring material, such as berrylium copper, the wire being bent to define a pair of flexible tines 37 and 38 extending from a mounting post 35. The normal or neutral position of the tines is such that they lie adjacent to but out of engagement with contacts 40 and 44, so that the circuit is normally open.

In order to close the circuit between contacts 40 and 44, it is necessary for the shorting bridge tines 37 and 38 to flex and simultaneously engage the contacts, for if only one of the contacts is engaged by a tine, the circuit remains open. To accomplish this result, there is provided a pair of freely swingable mallets 39 and 43, both of which are pivoted on a common axis, the mallets being symmetrically arranged relative to tines 37 and 38. Stops 26 and 27 are associated with the mallets to limit the retracted position thereof relative to the tines.

Because the mallets of the switch are free to move in the range determined by the tines and the stops, they will, depending on the movement of the wearer's arm, intermittently strike the tines, but the striking force of the mallets, which is a function of their mass and acceleration, is ordinarily insufficient to flex the tines to a degree causing the tines to engage the contacts. In order to develop sufficient acceleration to produce the required striking force, it is necessary to position the wrist and to rotate it in a particular manner to cause the mallets to be retracted or cocked relative to the tines and to be then fired to strike the tines.

Figure 4:
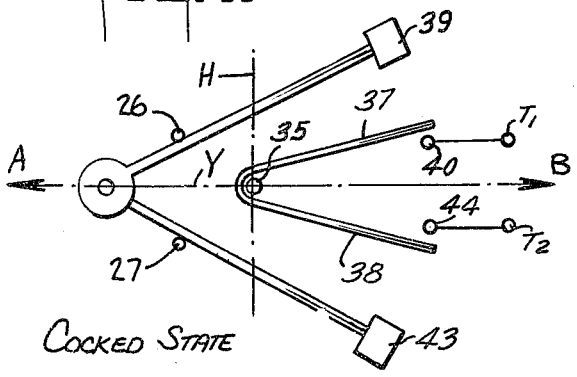
FIG. 4 shows the watch in its cocked state.
Figure 5:
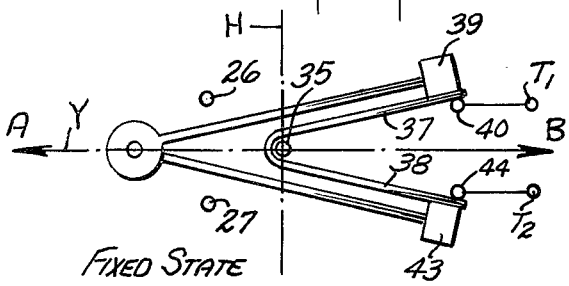
FIG. 5 shows the switch in its fired state.

In order to explain the sequence of wrist motions necessary to actuate switch S, the axis H passing through the switch on FIGS. 3, 4 and 5, represents the position of the wrist on which the switch is borne when the wrist is raised to the horizontal position. The vertical plane Y, which is normal to axis H, represents the plane of wrist rotation about the point of intersection P.

When the wrist is rotated in plane Y about point P in the clockwise direction, the switch tilts in direction A, and when wrist rotation is in the counterclockwise direction, the switch tilts in direction B.

FIG. 3 shows the position of the mallets when the wrist is horizontal. The mallets are then in their neutral position and lie against the tines. When the wrist is rotated gently in direction A, the mallets shift to their stop position, as shown in FIG. 4, in which position the mallets are retracted or cocked in readiness for firing.

When thereafter the wrist is rotated with a quick tilting motion or snap action in the B direction, the mallets 39 and 43 then swing to strike the tines with sufficient force to cause the tines to deflect and simultaneously engage contacts 40 and 44 to complete a circuit therebetween, thereby closing the switch and energizing the display to provide a time-of-day reading. This closing is momentary, for the flexible tines thereafter quickly return to their normal position out of engagement with the contacts. However the time display, once actuated, is maintained for a period, such as a second determined by the time constant of the circuit associated with the display.

It will be appreciated that wrist motions other than the sequence described above will cause the mallets to swing and strike the tines, but unless the motions are in the prescribed sequence, a simultaneous striking action will not take place and the switch will not close.

THE ACTUAL SWITCH

Figure 6:
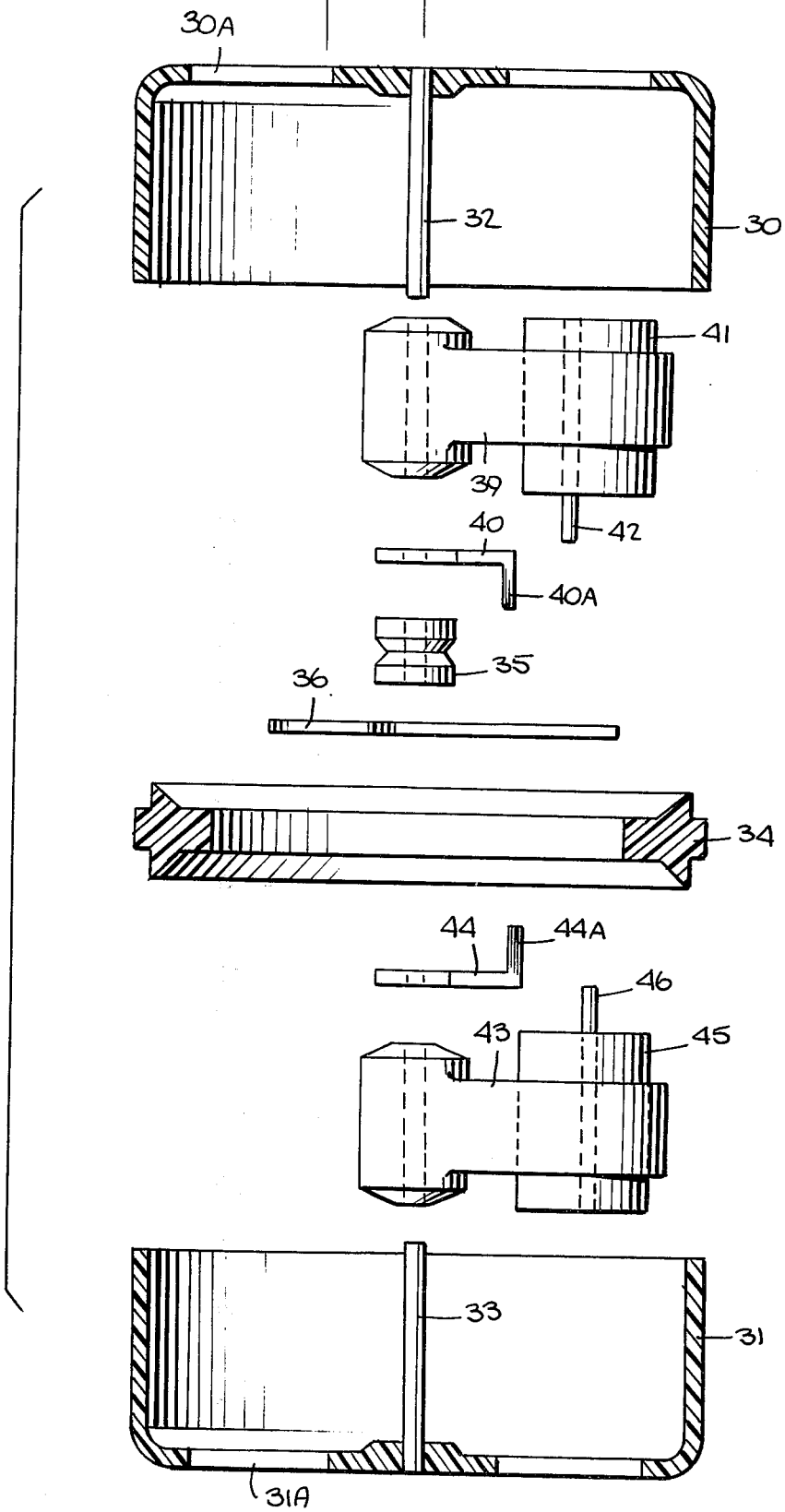
FIG. 6 is an exploded view of an actual embodiment of the switch.
Figure 6:
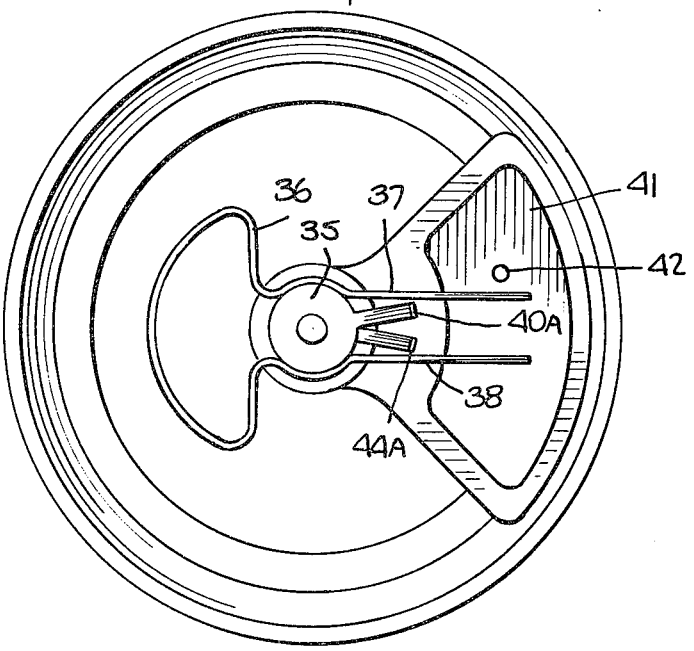
Figure 7:
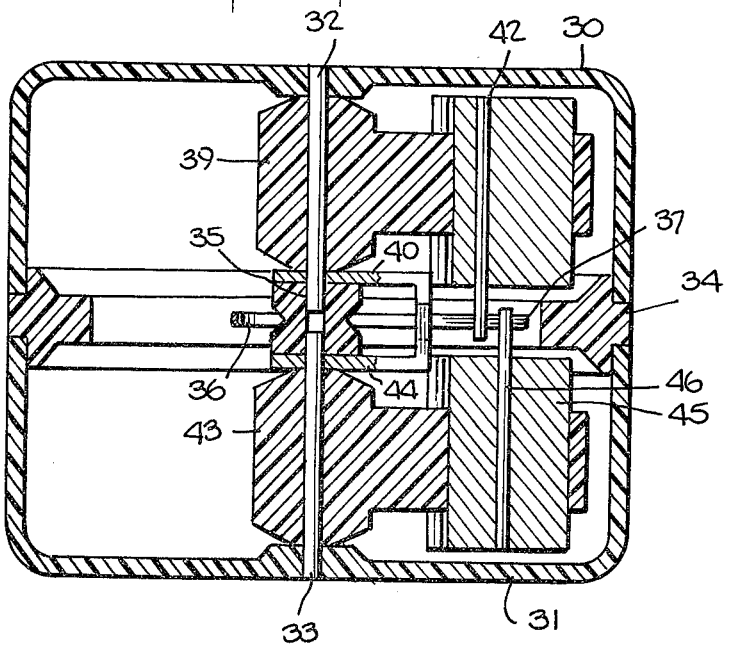
FIG. 7 is a section of the switch taken in the vertical plane.

Referring now to FIGS. 6, 7 and 8, showing a preferred embodiment of the actual switch structure, the switch includes a pair of complementary cup-shaped metal housing pieces 30 and 31 each having a central shaft 32 and 33, respectively, anchored in the top thereof. Each housing piece is provided with top openings 30A and 31A through which the interior of the housing is viewable.

The complementary housing pieces are joined together by means of an annular spacer 34 formed of plastic insulating material, so that when assembled, the pieces, which serve as the terminals of the switch, are electrically insulated from each other. The free ends of shafts 32 and 33 are received within opposite ends of a small plastic hub 35 which is held within the housing chamber at the center thereof.

Resiliently clamped to hub 35 is a shorting bridge 36 formed of a spring wire bent to assume a modified hairpin shape which defines a pair of spaced tines 37 and 38. As best seen in FIG. 8, the tines lie in a plane parallel to the tops of the housing pieces.

The first swinging mallet is formed by a plastic pendulum 39 freely mounted on shaft 32 and retained thereon by means of a metal contact 40 which is friction-fitted onto the shaft and is provided with a bent finger 40A normally disposed adjacent to and out of engagement with tine 37 when the tine is unflexed. Pendulum 39 has a fan-shaped frame formation that is fitted with a relatively heavy metal insert 41 serving as a weight to increase the effective mass of the swinging mallet. Projecting laterally from insert 41 is a striking pin 42 which is positioned to strike and deflect tine 37.

The second swinging mallet is similarly formed by a plastic pendulum 43 freely mounted on shaft 33 and retained thereon by means of a metal contact 44 which is friction-fitted on shaft 33, the contact having a bent finger 44A disposed adjacent to and out of engagement with tine 38 when this tine is unflexed. Pendulum 43 has a fan-shaped frame formation, and is provided with a metal insert 45 from which projects a striking pin 46 which is positioned to strike and flex tine 38.

When assembled, all parts of the switch are fixed, with the exception of the freely swinging pendulums and the resiliently-clamped shorting bridge. In the assembly procedure, the two housing pieces 30 and 31 are initially rotated relative to each other until contact fingers 40A and 44A almost touch tines 37 and 38. In practice, a spacing of about 0.005 inch is appropriate for this purpose.

Openings 30A and 31A in the tops of the complementary housing pieces are used for observing the contact adjustment. Once a proper adjustment has been made, the two pieces are cemented to the spacer 34 to prevent any further rotation. The switch may be connected to the module circuit by soldering leads onto the housing pieces.

The switch is installed in the module so that colinear shafts 32 and 33 are vertical when the wrist of the wearer is horizontally extended, such that when the wrist is thereafter rotated to tilt the switch in the A-direction, the two pendulums swing away from the tines to their retracted positions pins 42 and 45 in the retracted position of the pendulum make contact with each other and serve as stops to limit further movement of the pendulums. Then with a quick tilting motion in the reverse or B-direction, the two pendulums are caused to swing, one to the right and the other to the left. In swinging, the pendulums gain momentum until the striking pins 42 and 45 hit the tines, causing the tines to flex to engage the switch contacts.

After striking, the pendulums bounce back and come to rest at their neutral position. The locations of the striking pins on the pendulums are such that when both pendulums are hanging down in the B-direction, they just engage the tines of the shorting bridge. Under this condition, a sudden jar will not cause flexure of the tines to a degree making electrical contact. Electrical contact can be made only if the pendulums have sufficient momentum so that the striking pins simultaneously bump and bend the tines, so that both tines are flexed inwardly at the same time. But if only one time is bent at a time, a circuit will not be completed.

While there has been shown and described a preferred embodiment in accordance with the invention, it will be appreciated that many changes and modifications may be made therein without, however, departing from the essential spirit thereof.

For example, the same switch may be used with electronic instruments other than watches, such as a miniature transmitter borne on the person and operating only when the wrist-borne switch is actuated.

I claim:

1. An arm-actuated switch for an electronic device which is borne on the wrist of a wearer, said switch acting to close a circuit in said device to activate same only when the wearer's arm is made to undergo a predetermined sequence of motions, said switch comprising:

A. a pair of spaced contacts which when interconnected close said circuit;

B. a conductive shorting bridge having a pair of flexible tines symmetrically disposed with respect to said contacts, each tine in its neutral position being adjacent to but out of engagement with a respective contact, and C. a pair of swingable mallets pivoted on an axis normal to the axis of symmetry of said tines and so disposed with respect to said tines that the mallets are capable of being retracted and then swung to strike the tines simultaneously with sufficient force to bend the tines to cause them to engage the contacts and close the circuit only when the wearer moves his arm so that it undergoes said predetermined sequence of motions.

2. A switch as set forth in claim 1, wherein said sequence of motions involves a first step in which the arm is raised to a horizontal position, a second step in which the arm is rotated in one direction to tilt said switch to cause said mallets to retract relative to the tines, and a third step in which the arm is rotated in the reverse direction to cause said mallets to swing toward and strike said tines.

3. A switch as set forth in claim 2, wherein said device is a solid-state electronic watch having an electro-optical display having a control circuit which is connected to a battery for powering said display, and said switch is included in said control circuit whereby said display is provided with power only when said switch is closed.

4. A switch as set forth in claim 3, wherein said display is positioned on said watch to assume an optimum line-of-sight position when said switch is in the position determined by the third step.

5. A switch as set forth in claim 1, wherein said pair of spaced contacts is mounted on co-linear central shafts extending from the tops of a pair of complementary cup-shaped housing pieces which are joined together by an insulating spacer.

6. A switch as set forth in claim 5, wherein said mallets are formed by a pair of pendulums pivotally mounted on said shafts.

7. A switch as set forth in claim 6, wherein said pendulums are provided at their free ends with metal weights.

8. A switch as set forth in claim 6, wherein said shafts are joined by an insulating hub and said shorting bridge is formed of a hairpin-shaped wire which is resiliently clamped on said hub, the tines of the bridge cooperating with the contacts mounted on said shafts.

9. A switch as set forth in claim 8, wherein said weights have striking pins extending laterally therefrom to engage said tines.

10. An arm-actuated switch for an electronic device which is borne on the wrist of an arm of a wearer, said switch acting to close a circuit in said device to activate same only when the arm is made to undergo a predetermined multi-step sequence of motions, said switch comprising:

A upper and lower complementary cup-shaped metal pieces joined together by an insulating spacer to define a chamber, each piece having a central metal shaft extending along a common axis, the two shafts being joined together by an insulating hub positioned at the midpoint of the chamber, whereby the metal pieces constitute the terminals of the switch;

B upper and lower contact elements mounted on the respective shafts and extending laterally therefrom at different angles, the upper element having a downwardly bent finger and the lower element having an upwardly bent finger, said fingers defining a pair of spaced contacts;

C a shorting bridge formed by a hairpin-shaped wire clamped onto said hub and having a pair of resilient tines symmetrically disposed relative to said spaced contacts, each tine in its neutral position being adjacent to but out of engagement with a respective contact; and D upper and lower pendulums pivoted on the respective shafts of the upper and lower pieces, each pendulum having a mallet at the free end thereof for striking a respective tine, said mallets being capable of being retracted and then swung to strike the tines simultaneously with sufficient force to bend the tines inwardly to cause them to engage the contacts and close the circuit only when the wearer moves his arm so that it undergoes said predetermined sequence of motion.

11. A switch as set forth in claim 10, said switch being so oriented that said common shaft axis lies in the vertical plane when the wearer's arm in the first step in said sequence is raised to a horizontal position, whereby when the arm in the second step in said sequence is rotated in one direction to tilt said switch, said mallets retract relative to said tines, and when the arm in the third step in said sequence is rotated in the reverse direction, the mallets are caused to swing toward and strike said tines.

* * * * *